US008005585B2

(12) United States Patent
Klemm

(10) Patent No.: US 8,005,585 B2
(45) Date of Patent: Aug. 23, 2011

(54) METHOD FOR DETERMINING THE OCCUPANCY STATUS OF A TRACK SECTION IN PARTICULAR FOLLOWING A RESTART OF AN AXLE COUNTING SYSTEM, AS WELL AS AN EVALUATION DEVICE AND COUNTING POINT FOR THIS

(75) Inventor: Rainer Klemm, Steinheim (DE)

(73) Assignee: Alcatel, Paris (FR)

( * ) Notice: Subject to any disclaimer, the term of this patent is extended or adjusted under 35 U.S.C. 154(b) by 1408 days.

(21) Appl. No.: 10/885,588

(22) Filed: Jul. 8, 2004

(65) Prior Publication Data

US 2005/0015185 A1 Jan. 20, 2005

(30) Foreign Application Priority Data

Jul. 18, 2003 (EP) ..... 03291782

(51) Int. Cl.
*B61L 1/16* (2006.01)

(52) U.S. Cl. ..... 701/19; 701/116; 246/247

(58) Field of Classification Search ..... 701/19, 701/116; 235/103, 104; 246/182 R, 247; *B61L 1/16*
See application file for complete search history.

(56) References Cited

U.S. PATENT DOCUMENTS

| | | | | | |
|---|---|---|---|---|---|
| 3,736,420 | A * | 5/1973 | Elder et al. | ..... | 246/182 A |
| 4,248,396 | A * | 2/1981 | Hunt, Jr. | ..... | 246/247 |
| 4,787,581 | A * | 11/1988 | Dobler et al. | ..... | 246/247 |
| 5,757,178 | A * | 5/1998 | Luehrs et al. | ..... | 324/178 |
| 6,360,337 | B1 * | 3/2002 | Zak et al. | ..... | 714/47 |
| 6,523,787 | B2 * | 2/2003 | Braband | ..... | 246/3 |
| 6,810,312 | B2 * | 10/2004 | Jammu et al. | ..... | 701/29 |
| 7,209,811 | B1 * | 4/2007 | Goricke et al. | ..... | 701/19 |
| 2004/0230355 | A1 * | 11/2004 | Theurer et al. | ..... | 701/19 |

FOREIGN PATENT DOCUMENTS

| | | | |
|---|---|---|---|
| CH | 296516 | | 4/1954 |
| DE | 4327674 | * | 8/1993 |
| DE | 43 27 674 | A1 | 2/1995 |
| EP | 1 101 684 | A1 | 5/2001 |

* cited by examiner

*Primary Examiner* — Mark Hellner
*Assistant Examiner* — Ari M Diacou
(74) *Attorney, Agent, or Firm* — Sughrue Mion, PLLC

(57) ABSTRACT

A method and apparatus for determining the occupancy status of a track section, in particular following a restart of an axle counting system, in which a counting-in axle counting point is provided at the start and a counting-out axle counting point is provided at the end of the track section. The occupancy status is determined by a comparison of the counting values currently ascertained by these axle counting points. The current counting value of the counting-in axle counting point and the current counting value of the counting-out axle counting point are stored following clearing of the track section. To determine the new occupancy status later, the values thus stored are called on together with the counting values current at the time.

11 Claims, 4 Drawing Sheets

S1

| | AUS1 | AKT1 | EIN1 |
|---|---|---|---|
| a | - | 10 | **10** |
| b | - | 14 | 10 |
| c | - | 14 | 10 |
| d | - | 14 | **14** |
| e | - | 14 | 14 |
| f | - | 14 | 14 |

S2

| AUS2 | AKT2 | EIN2 |
|---|---|---|
| **10** | 10 | **10** |
| 10 | 10 | 10 |
| 10 | 11 | 10 |
| **14** | 14 | 10 |
| 14 | 14 | 10 |
| 14 | 14 | **14** |

S3

| AUS3 | AKT3 | EIN3 |
|---|---|---|
| **10** | 10 | - |
| 10 | 10 | - |
| 10 | 10 | - |
| 10 | 10 | - |
| 10 | 13 | - |
| **14** | 14 | - |

Fig.2

| | A1 | A2 |
|---|---|---|
| | (AKT1 - AKT2) – (EIN1 - AUS2) | (AKT2 – AKT3) – (EIN2 – AUS3) |
| b | (14 -10) – (10 -10) = 4 (Belegt) | (10 – 10) – (10 – 10) = 0 (Frei) |
| c | (14 -11) – (10 -10) = 3 (Belegt) | (11 -10) – (10 -10) = 1 (Belegt) |
| d | (14 -14) – (14 -14) = 0 (Frei) | (14 -10) – (10 -10) = 4 (Belegt) |
| e | (14 -14) – (14 -14) = 0 (Frei) | (14 -13) – (10 -10) = 1 (Belegt) |
| f | (14 -14) – (14 -14) = 0 (Frei) | (14 -14) – (14 -14) = 0 (Frei) |

Fig.3

METHOD FOR DETERMINING THE OCCUPANCY STATUS OF A TRACK SECTION IN PARTICULAR FOLLOWING A RESTART OF AN AXLE COUNTING SYSTEM, AS WELL AS AN EVALUATION DEVICE AND COUNTING POINT FOR THIS

BACKGROUND OF THE INVENTION

The invention is based on a priority application 03291782.5 which is hereby incorporated by reference.

Track clear signalling devices are among the basic devices in railway signalling. These devices ascertain the occupancy status of successive individual sections of a length of track, on the basis of which signalling is carried out to trains entering or passing through this length of track.

Track clear signalling is performed increasingly by means of so-called axle counting systems, in which the axles of trains entering and exiting are counted at individual counting points and these results are compared with one another in a suitable manner. To determine the occupancy of a track section, the axles of a train entering and exiting are counted at certain points at the start of the section by means of a counting-in point and at the end of the section by means of a counting-out point. By forming the difference between the axles counted in and counted out it can be determined whether the track section is clear or occupied, i.e. one of the states "clear" or "occupied" can be assigned to the track section.

In the modern multiple section axle counters from Alcatel SEL AG, for example, the axles are counted in microcontroller-based counting points on the track and the track clear signalling for all track sections is determined in the axle counter evaluation devices in the signal box.

The disadvantage compared with track circuits, in which the track clear signalling is determined by ascertaining the electrical resistance between the rails of a track along the entire track section, is that following a restart of an axle counter it cannot be established initially whether a train is located in the pertinent track section.

Following a restart of an axle counter, a manual reset of the track sections is thus necessary. The reset is relevant to safety and must therefore be carried out with the utmost care. To do this, the following procedures can be executed:

In a first type of reset, the train controller alone assumes full responsibility for carrying this out, once he has satisfied himself visually or by enquiry that the pertinent track section is clear.

In a second type of reset, the train controller likewise assumes responsibility, but to support him a train passes "to order" through the section with caution to ensure that the pertinent track section is clear.

In both the aforementioned types of reset, after it has been ensured that there is no train in the sections under consideration, a manual entry has to be made in the track clear signalling device, with which the pertinent counters or storage devices are then finally reset.

Since the security of the track clear signalling system against malfunctions is indispensable, all faults in the track clear signalling system must be detected and a secure shutdown must ensue as soon as a malfunction is detected. In the case of axle counter evaluation devices with a 2-computer architecture common in safety engineering, this results in a shutdown as soon as one of these computers fails. For routes with a high traffic volume, e.g. main Deutsche Bahn routes, evaluation devices are therefore executed in so-called 2 out of 3 computer technology, in which the failure of one computer can be tolerated and due to which the reliability and availability of the evaluation device and thus of the axle counter system as a whole is markedly increased.

However, in spite of the use of highly reliable computer systems, for example based on the previously mentioned 2 out of 3 computer technology, failures of the system can continue to occur if for example the transmission between one of the counting points and the axle counter evaluation device fails.

A restart of the axle counter system is also always necessary if there is a change in planning data or a software update of the axle counter evaluation device. In all these cases, a time-consuming manual reset that hinders operation continues to be required, as described above.

SUMMARY OF THE INVENTION

The object of the invention is to create a method and suitable means that facilitate an automatic reset in the event of a restart of an axle counting system.

This object is achieved according to the invention by a method for determining the occupancy status of a track section, in particular following a restart of an axle counting system, in which a counting-in axle counting point is provided at the start and a counting-out axle counting point at the end of the track section, and wherein the occupancy status is determined by a comparison of the counting values currently ascertained by these axle counting points. An counting point with a counting point logic, which has a counter for counting the currently passing axles of a traction vehicle and with a transmitting device for transmitting counter values, wherein a receiving device for receiving a storage command and at least one storage device for storing a current counting value are present, and evaluation device for determining the occupancy status of at least one track section with a receiving device for receiving counter values from at least two corresponding counting points and an evaluation logic for evaluating these counter values, wherein a transmitting device is present for transmitting a storage command to the counting points to store the current counter value in each case.

The fundamental idea of the invention is that even during the failure of the axle counting system or of a transmission section in the axle counting system, the counting points continue to operate independently and information, in particular counting values relating to the status prior to the failure, is saved securely in signalling terms. Following a restart of the axle counting system, this saved information is linked with the current counting values transmitted by the counting points to the evaluation device, in order to regenerate the current occupancy status of the track sections.

When determining the occupancy status of this track section afresh, a difference in the saved values and a difference in the current counting values are formed respectively. The track section (A1) is only clear if both differences are identical.

The axle counting system advantageously comprises a central axle counting evaluation device, which is connected to the counting points. When the track section becomes clear, the axle counting evaluation device transmits a command to save the current counting value in each case to the counting point counting in and the counting point counting out. Each counting point transmits its last stored value together with the currently determined counting value to the evaluation device.

Each counting point according to the invention contains for this purpose a counting-in storage device and a counting-out storage device, in each of which an axle number can be stored, as well as two further storage devices respectively, a status storage device for the counting-in storage device, in short counting-in status storage device, and a status storage device for the counting-out storage device, in short counting-out status storage device, for storing respectively a digital status value of the counting point as a counter-in and counter-out; which assume respectively the meaning "current" or "not current".

Following starting of a counting point, the status values are set initially to "not current". Furthermore, the counting points set the status storage devices to "not current" if:

a fault is established in the context of their normal self-tests, their fault disclosure time (for example 72 h) has expired or their rotating counter AKT overruns more than half (the direction of travel of a train can then no longer be recognized unambiguously; with certain axle counters this is the case for example at more than 256 axles).

As also known from the prior art, the central evaluation device determines the track clear signalling for a section by processing the currently ascertained and transmitted axle numbers of those counting points that delimit this section. As soon as a section assumes the status "clear", it transmits a command to these counting points with which the respectively current counting value is to be saved n their counting-in storage device and their counting-out storage device. The status value is set by the pertinent counting point to "current" in this case and filed in the pertinent counting-in status storage device and counting-out status storage device respectively. Thus the axle numbers that have resulted in the clear signalling of this section are filed in the counting points of a section.

The counting points signal respectively the counting values stored in the counting-in and counting-out storage devices as well as the contents of the status storage devices to the evaluation device. These messages can be sent cyclically or following a request by the evaluation device. These contents of the counting and status storage devices are preferably transmitted together with the current counting values to the evaluation device, so that they can be used there if necessary for regeneration without the counting points having to be informed of a failure.

Due to this, as described at the beginning, the occupancy status on a section of line can be determined directly following a restart, even if train movements have taken place in the meantime or new counting information could not be received for a certain time. Following restoration of a failed data transmission between a counting point and the evaluation device, the track free signalling of the sections affected by this can be restored. Following a change in the planning data of the axle counter evaluation device, the track clear signalling can be restored for those sections for which the configuration has not changed.

The evaluation device can perform regeneration for a line section if the status storage devices of all counting points of this section are signalled as "current". If this is not the case, the pertinent section is regarded initially as "disrupted" following a restart. If applicable, it is also possible to bring several track sections together first of all so that only counting values of counters with currently signalled counting storage devices are required.

The method according to the invention has the advantage compared with manual and conventional methods that following a restart of the evaluation device, for example as a result of maintenance work, repair or a software update of the evaluation device, the track clear signalling of all sections can be regenerated automatically and without any significant loss of time. The method according to the invention can be used with any computer architectures of the evaluation device, for example with a 2 out of 3 or 2 out of 2 computer configuration.

BRIEF DESCRIPTION OF THE DRAWINGS

The method according to the invention is explained further below on the basis of a simple example with reference to the drawings:

FIG. 1 shows a simple block diagram of an axle counting system according to the invention with an evaluation device according to the invention and axle counting points according to the invention and FIG. 2 shows a table with examples of storage device states of axle counting points according to the invention of the axle counting system from FIG. 1*a* assigned in an execution of the method according to the invention and FIG. 3 shows the results of determining occupancy states in table form with reference to the storage device states from FIG. 2.

FIG. 1 shows a block diagram of an axle counting system AZS according to the invention with an (axle counter) evaluation device AZA according to the invention and by way of example three (axle) counting points ZP1, ZP2 and ZP3 according to the invention. The first counting point ZP1 is located at the left end point of a first track section A1, the second counting point ZP2 is located at the right end point and at the same time the left end point of a second track section A2 connecting on to the first track section A1 on the right, and the third counting point ZP3 is at the right end point of the second track section A2. As an example, a traction vehicle TFZ is illustrated ahead of section A1, which vehicle is moving from left to right. Furthermore, arrows a-f are drawn in, which indicate line locations of line points selected by way of example.

The counting points ZP1, ZP2 and ZP2 each consist according to the prior art of an axle detector device, which is attached at a suitable spacing and a suitable height next to the rail. Each axle detector device has a transmitting coil, which generates an electromagnetic alternating field around the rail. A receiving coil is arranged in the sphere of influence of this alternating field, for example opposite the transmitting coil on the other side of the rail. When an axle travels past, the field geometry of the alternating field changes. This change is received by the receiving coil and evaluated in an electronic evaluation circuit, in which it is decided whether an axle has passed or not. The result is transmitted to a counting point computer, which increments a counting storage device accordingly. The evaluation circuit, counting point computer, storage device and communication device can be accommodated in a housing close to the respective detector.

Figure 4:
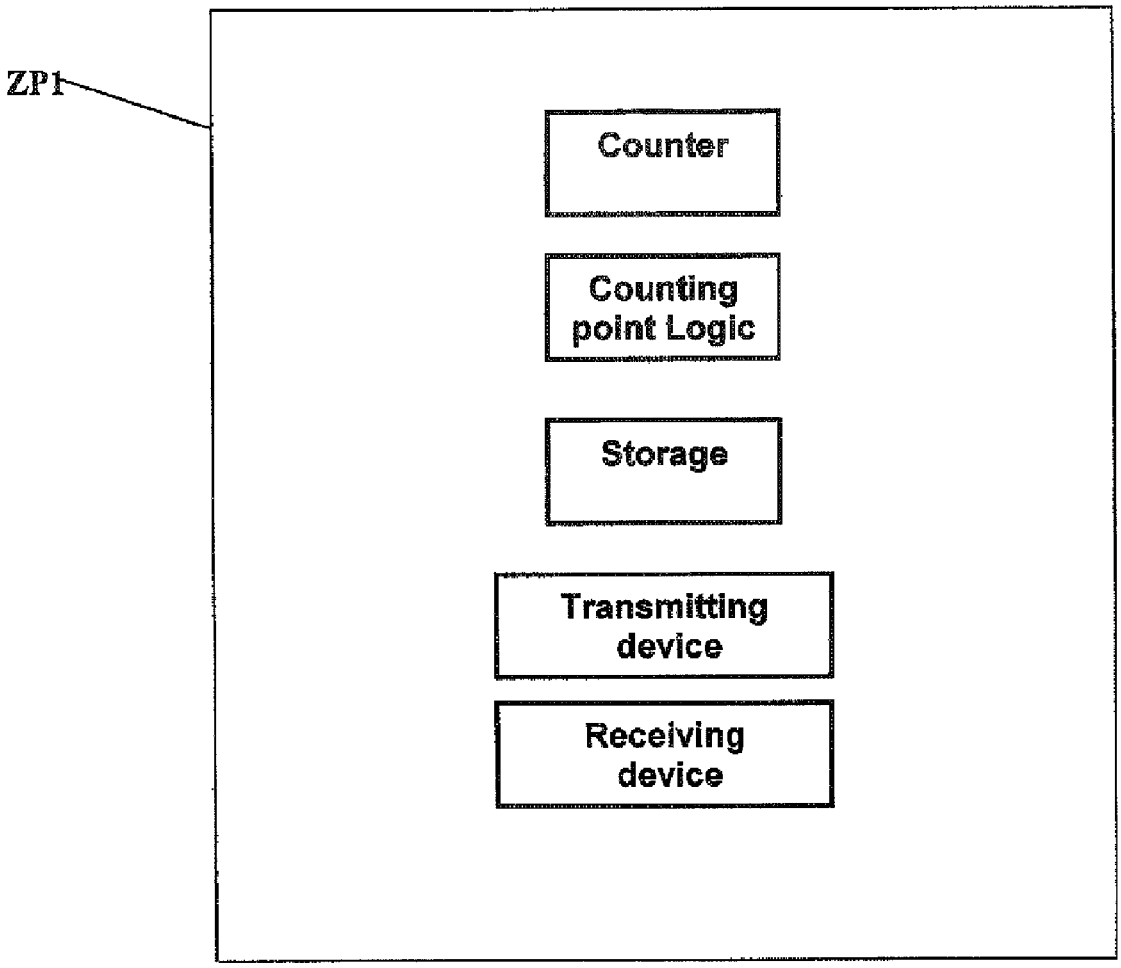
FIG. 4 shows non-limiting features provided in a counting point.

As shown in FIG. 4, the counting points ZP1 (and ZP2-ZP3) may contain a counter, counting point logic, a storage unit, a transmitting device and a receiving device.

Figure 1:
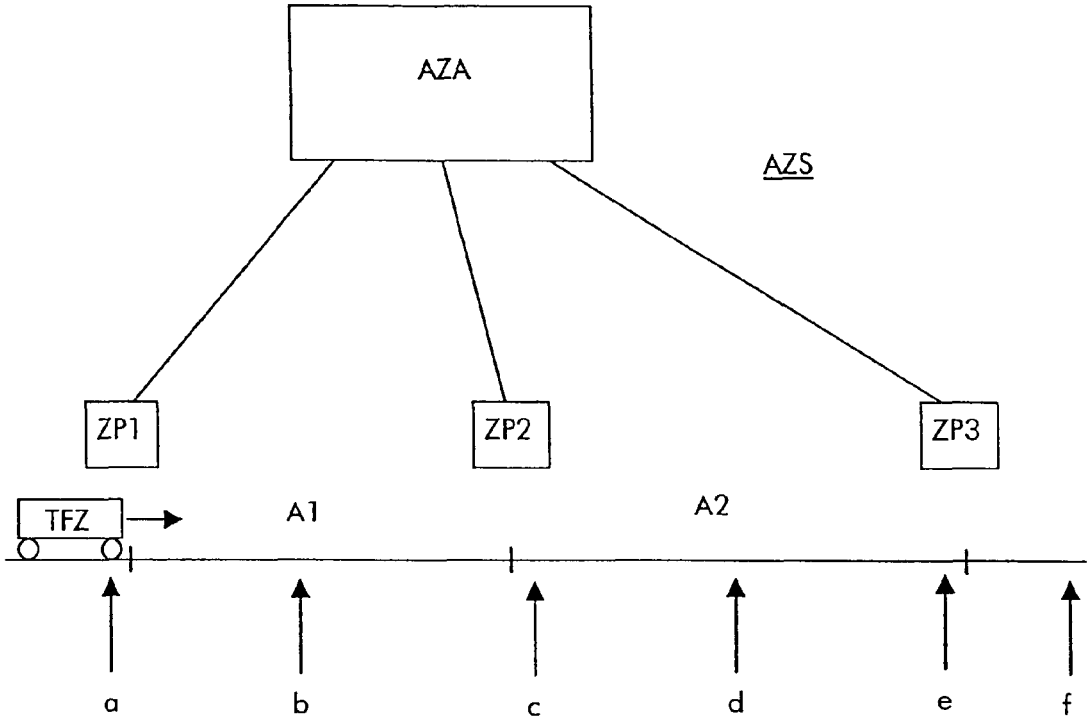

The storage of counting values in the counting points ZP1-ZP3 shown in FIG. 1 for executing the method according to the invention when the four-axle traction vehicle TFZ passes over the line locations a-f shown in FIG. 1 is now to be explained with reference to FIG. 2.

According to the invention, the first, second and third counting point ZP1, ZP2 and ZP3 each has a storage device S1, S2 and S3, with the following storage cells:

first counter and current counting storage unit AKT1, second counter AKT2 and third counter AKT3, which are each incremented when an axle passes, first counting-in storage device EIN1, second counting-in storage device EIN2 and third counting-in storage device EIN3, into which, on a command received from the evaluation device AZA to take the counting-in value over, the value of the first counter AKT1, second counter AKT2 or third counter AKT3 is taken over, first counting-out storage device AUS1, second counting-out storage device AUS2 and third counting-out storage device AUS3, into which, on a command received from the evaluation device AZA to take the counting-out value over, the value of the first counter AKT1, second counter AKT2 or third counter AKT3 is taken over.

The above mentioned counting-in status storage devices counting-in storage devices ST_EIN1, ST_EIN2 or ST_EIN3 and counting-out status storage devices ST_AUS1, ST_AUS2 or ST_AUS3 are not shown, in which bit information is stored respectively that indicates whether the corresponding counting-in storage device EIN1, EIN2 or EIN3 and counting-out storage device AUS1, AUS2 or AUS3 has stored a valid counting value.

In the example shown here, the second counting point ZP2 serves both as a counting-out point from the first section A1 and as a counting-in point into the second section A2. Of the first counting point ZP1 only the counting-in function into the first section A1 and of the third counting point ZP3 only the counting-out function from the second section A2 are considered here. The first counting-out storage device AUS1 and the third counting-in storage device EIN3 and the related status storage devices will thus not be considered further below.

In real systems, however, each counting point normally acts both as a counting-in point into the section lying ahead and as a counting-out point from the section lying behind.

The following exemplary initial status is assumed here:

all status storage devices are set, i.e. assume the value "current", both sections are clear, the vehicle TFZ with for example 4 axles travels from left to right over the two sections A1 and A2; the front axle of the traction vehicle passes the line locations a-f one after another in this case, all counting-in and counting-out storage devices have saved the value 10.

Below the storage device contents of the counters, counting-in and counting-out storage devices of the counting points respectively at the times at which the first axle of the traction vehicle TFZ reaches the locations a-f:

a) The vehicle has not yet entered: both sections A1 and A2 are clear.

b) The vehicle TFZ enters section A1. Section A1 is occupied by 4 axles; section 2 is clear. The first counter AKT1 has thus been increased by the value "4" to the value "14".

c) The first axle of the vehicle TFZ has entered section A2. Section A1 is still occupied by 3 axles; section A2 is occupied by one axle. The second counter AKT2 has thus been increased by the value "1" to the value "11".

d) The vehicle TFZ has fully entered section A2. Section A1 is clear once again and section two is occupied by 4 axles. The second counter AKT2 has thus been increased by the value "3" to the value "14". The evaluation device AZA detects the clearing of the first section A1 by comparing the first and second counter AKT1 and AKT2, transmits respectively a command to the first counting point ZP1 to take the current first counter AKT1 (counting-in value="14") over into the first counting-in storage device EIN1 and a command to the second counting point ZP2 to take the current second counter AKT2 (counting-out value="14") over into the second counting-out storage device AUS2.

e) Three axles of the vehicle TFZ exit section A2. Section 2 is still occupied by one axle. The third counter AKT3 has thus been increased by the value "3" to the value "13".

f) The vehicle TFZ has exited section A2 completely. Both sections are clear again. The third counter AKT3 has thus been increased by the value "1" to the value "14". The evaluation device AZA detects the clearing of the second section A2 by comparing the second and third counter AKT2 and AKT3, transmits respectively a command to the second counting point ZP2 to take the current first counter AKT2 (counting-in value="14") over into the second counting-in storage device EIN2 and a command to the third counting point ZP3 to take the current third counter AKT3 (counting-out value="14") over into the third counting-out storage device AUS3.

It is to be shown with reference to FIG. 3 how the occupancy status of the sections A1 and A2 can be determined with the help of the storage device values transmitted to the evaluation device alone, without the occupancy status of these sections having to be known in the evaluation device in advance. This is determined here by way of example respectively at the times at which the vehicle reaches the locations b-f:

To determine the occupancy of the first track section A1, a difference is formed respectively between the stored values of the first counting-in storage device EIN1 and the second counting-out storage device AUS 2 and between the current counting values AKT1 and AKT2 and it is verified whether these differences correspond:

$$(AKT1-AKT2)-(EIN1-AUS2)=0\ ?$$

If yes, the first section A1 is clear, otherwise it is occupied.

To determine the occupancy of the second track section A2, the following test is carried out accordingly:

$$(AKT2-AKT3)-(EIN2-AUS3)=0\ ?$$

FIG. 3 shows the pertinent results in table form. These results correspond to the scenario described under FIG. 2.

Naturally the equations described above can be rearranged in any mathematical form, for example they can be put into the following form:

$$(AKT1-EIN1)-(AKT2-AUS2)=0\ ?\ \text{and}$$

$$(AKT2-EIN2)-(AKT3-AUS3)=0\ ?$$

It is then also possible, for example, for the first counting point ZP1 to form the difference (AKT1−EIN1), the second counting point ZP2 to form the differences (AKT2−AUS2) and (AKT2−EIN2) and the third counting point ZP3 to form the difference (AKT3−AUS3) in advance and for the counting points to transmit respectively only these differences to the evaluation device AZA.

Figure 5:
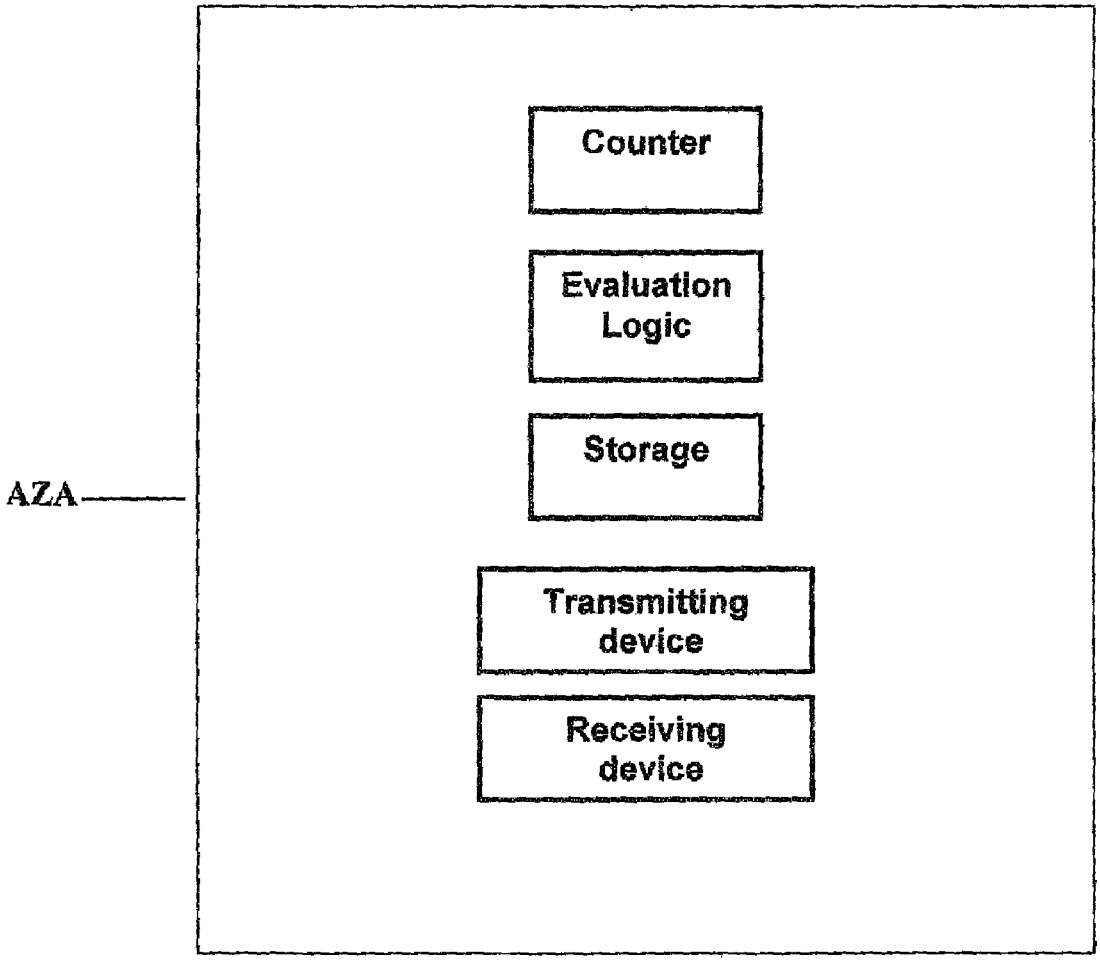
FIG. 5 shows non-limiting features provided in an evaluation device.

As shown in FIG. 5, the evaluation device AZA may contain a counter, evaluation logic, a storage unit, a transmitting device and a receiving device.

The invention claimed is:

1. A method for determining the occupancy status of a track section, in particular following a restart of an axle counting system, in which a counting-in axle counting point is provided at the start and a counting-out axle counting point at the end of the track section, said method comprising the steps of:

determining the occupancy status by comparing the counting values currently ascertained by said axle counting points, following clearing of the track section, storing the current counting value of the counting-in axle counting point and the current counting value of the counting-out axle counting point, and to determine the occupancy status afresh at a given time, using the values thus stored together with the counting values current at said given time, wherein on clearing of the track section, an axle counting evaluation device transmits a command to store the current counting value to the counting-in counting point and the counting-out counting point, and that to determine the following occupancy status each counting point transmits its stored value together with the counting value currently ascertained afresh to the evaluation device.

2. A method according to claim 1, wherein when determining the occupancy status of this track section afresh, a value is formed that corresponds to a difference between the difference in the stored values and the difference in the current counting values and the track section is only determined as clear if this value is equal to zero.

3. A method according to claim 1, wherein the counting point, when storing the current counting value, additionally stores a certain value as status information that provides information that a valid current counting value has been stored and that the counting point transmits this status information together with the stored value and the current counting value to the evaluation device.

4. A method according to claim 3, wherein this status information is deleted in the counting point as soon as this counting point:

detects an internal error, is restarted, a certain fault disclosure time has expired or the rotating counter for storing the current counting value overruns more than half.

5. A method according to claim 4, wherein the evaluation device, following receipt of the stored values and the status information, checks with reference to the value stored in the status information whether these stored values are valid.

6. A counting point with a counting point logic, comprising:

a counter for counting currently passing axles of a traction vehicle, a transmitting device for transmitting counter values of said counter, a receiving device for receiving a storage command, and at least one storage device for storing a current counting value on receipt of said storage command following clearing of a track section, wherein, when storing the current counting value, the storage device additionally stores a certain value as status information, the status information providing information that a valid current counting value has been stored.

7. An evaluation device for determining an occupancy status of at least one track section, said evaluation device comprising:

a receiving device for receiving counter values from at least two corresponding counting points of the at least one track section, an evaluation logic for evaluating the received counter values, a transmitting device for transmitting a storage command to the at least two corresponding counting points to store a current counter value for each counting point, and the evaluation logic being configured so that the occupancy status of the track section can be determined solely from the received counter values, wherein said at least two corresponding counting points comprise a counting-in axle counting point at a start of said track section and a counting-out axle counting point at an end of said track section, said evaluation device further including means for storing current counting values of said counting-in and counting out axle counting points following clearing of the track section and for subsequently determining the occupancy status from the stored values together with the counting values current at the subsequent time, wherein said transmitting device transmits said storage command to said counting-in and counting-out axle counting points on clearing of the track section, and at said subsequent time each counting point transmits its stored value together with the counting value currently ascertained to said evaluation device, and wherein each counting point, when storing the current counting value, additionally stores a certain value as status information that provides information that a valid current counting value has been stored and wherein the counting point transmits this status information together with the stored value and the current counting value to said evaluation device.

8. An axle counting system with an evaluation device for determining an occupancy status of at least one track section, said evaluation device comprising:

a receiving device for receiving counter values from at least two corresponding counting points of the at least one track section, an evaluation logic for evaluating the received counter values, and a transmitting device for transmitting a storage command to the at least two corresponding counting points to store a current counter value for each counting point, the evaluation logic being configured so that the occupancy status of the track section can be determined solely from the received counter values, wherein said at least two counting points comprise counting points according to claim 6.

9. A device according to claim 7, wherein at said subsequent time said evaluation device forms a value corresponding to a difference between a difference in the stored values and a difference in the current counting values, and the track section is only determined as clear if this value is equal to zero.

10. A device according to claim 7, wherein said status information is deleted in each counting point as soon as the counting point detects an internal error or is restarted, or certain fault disclosure time has expired or a rotating counter for storing the current counting value overruns more than half.

11. A device according to claim 10, wherein said evaluation device includes means for, following receipt of the stored values and the status information, checking with reference to the value stored in the status information whether these stored values are valid.

* * * * *